US011047579B2

(12) United States Patent
Lee et al.

(10) Patent No.: US 11,047,579 B2
(45) Date of Patent: Jun. 29, 2021

(54) OVEN

(71) Applicant: Samsung Electronics Co., Ltd., Suwon-si (KR)

(72) Inventors: Se Min Lee, Yongin-si (KR); Sung-Soo Park, Hwaseong-si (KR); Chang Hyun Son, Hwaseong-si (KR); Sung Min Oh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 866 days.

(21) Appl. No.: 15/698,838

(22) Filed: Sep. 8, 2017

(65) Prior Publication Data

US 2018/0066851 A1 Mar. 8, 2018

(30) Foreign Application Priority Data

Sep. 8, 2016 (KR) ..... 10-2016-0115371

(51) Int. Cl.
*F24C 15/00* (2006.01)

(52) U.S. Cl.
CPC ..... *F24C 15/008* (2013.01)

(58) Field of Classification Search
CPC ..... F24C 15/008; F21V 33/0092; F21V 33/0044; F21W 2131/307
USPC ..... 99/341; 126/19 R, 273 R; 362/92, 126, 362/365; 219/402, 411, 685; 392/418; 313/113
See application file for complete search history.

(56) References Cited

U.S. PATENT DOCUMENTS

| | | | | |
|---|---|---|---|---|
| 2,332,362 | A * | 10/1943 | Bartow | B64F 1/20 362/311.09 |
| 4,880,955 | A | 11/1989 | Nitzinger et al. | |
| 5,760,531 | A * | 6/1998 | Pederson | F21S 45/47 313/25 |
| 6,093,919 | A | 7/2000 | Seo et al. | |
| 7,267,450 | B2 * | 9/2007 | Ha | F24C 15/008 219/758 |
| 2007/0125761 | A1 * | 6/2007 | Nam | F24C 15/16 219/392 |
| 2011/0100227 | A1 * | 5/2011 | Boussemart | A47J 39/00 99/275 |

FOREIGN PATENT DOCUMENTS

| | | | |
|---|---|---|---|
| EP | 0 521 248 | 1/1993 | |
| EP | 1574787 A2 * | 9/2005 | F24C 15/008 |
| JP | 2012-251738 | 12/2012 | |
| KR | 10-2005-0056053 | 6/2005 | |

* cited by examiner

*Primary Examiner* — Dana Ross
*Assistant Examiner* — James F Sims, III
(74) *Attorney, Agent, or Firm* — Staas & Halsey LLP

(57) ABSTRACT

Disclosed herein is an oven with a doubly insulated lamp having increased lifetime. The oven may include a cooking chamber, a first insulating case mounted on one surface of the cooking chamber, a first case coupled to the first insulating case to form a first insulated space, a second insulating case having at least a part thereof disposed inside the first insulated space, a second case coupled to the second insulating case to form a second insulated space, and a lamp disposed inside the second insulated space to be doubly insulated from heat of the cooking chamber.

20 Claims, 11 Drawing Sheets

OVEN

CROSS-REFERENCE TO RELATED APPLICATION

This application claims the benefit of Korean Patent Application No. 10-2016-0115371, filed on Sep. 8, 2016 in the Korean Intellectual Property Office, the disclosure of which is incorporated herein by reference.

BACKGROUND

1. Field

Embodiments of the present disclosure relate to an oven, and more specifically, to an oven including a lamp having a double insulation structure.

2. Description of the Related Art

Generally, an oven is an apparatus for cooking food by being provided with a cooking chamber, a heating device configured to apply heat to the cooking chamber, and a circulating fan configured to circulate the heat generated by the heating device in the cooking chamber.

An oven is an apparatus for cooking food by sealing and heating the food, and can be generally classified into an electric oven, a gas oven, and a microwave oven according to a heat source. The electric oven uses an electric heater as a heat source, and the gas oven and the microwave oven use gas heat and frictional heat from water molecules due to a high frequency as heat sources, respectively.

A state of food inside a cooking chamber need be checked during a cooking process using an oven. Thus, a lamp is provided at the cooking chamber or a door for opening or closing the cooking chamber.

The lamp can be heated by heat of the cooking chamber. When the lamp overheats, a lifetime of the lamp can be decreased.

SUMMARY

Therefore, it is an aspect of the present disclosure to provide an oven including a lamp having a double insulation structure.

It is another aspect of the present disclosure to provide an oven configured to prevent a lamp disposed adjacent to a cooking chamber from being overheated.

It is still another aspect of the present disclosure to provide an oven in which a lifetime of a lamp configured to illuminate an inside of a cooking chamber is increased.

Additional aspects of the disclosure will be set forth in part in the description which follows and, in part, will be obvious from the description, or may be learned by practice of the disclosure.

In accordance with one aspect of the present disclosure, an oven includes a cooking chamber, a first insulating case mounted on one surface of the cooking chamber, a first case coupled to the first insulating case to form a first insulated space, a second insulating case having at least a part thereof disposed inside the first insulated space, a second case coupled to the second insulating case to form a second insulated space, and a lamp disposed inside the second insulated space to be doubly insulated from heat of the cooking chamber.

The first case may include a through hole through which a part of the second case and a part of the second insulating case pass.

The first case may further include a location determination groove formed outwardly in a radial direction of the through hole from one side of the through hole.

The second case may include a location determination protrusion formed to protrude outward in the radial direction from a side surface of the second case to correspond to the location determination groove.

The first case may include an elastic piece provided on a side surface thereof and the first insulating case may include a hooking groove provided to catch the elastic piece.

The first insulating case may include a boss part inserted into the first case.

The oven may further include a ring member provided between the first case and the second insulating case to minimize a gap between the first case and the second insulating case.

Each of the first case and the second case may include an outlet to discharge heat.

The outlet is formed by at least a part of each of the first case and the second case being bent.

The second insulating case may include a screw and the second case may include a coupling protrusion provided to be screw-coupled to the screw.

The coupling protrusion may be disposed in a spiral form along an inner circumference surface of the second case.

Each of the first insulating case and the second insulating case may include a glass material.

The lamp may include a halogen lamp.

The first insulating case may be mounted on an upper surface of the cooking chamber.

The first insulating case may be mounted on a side surface of the cooking chamber.

In accordance with another aspect of the present disclosure, a lamp assembly includes a first insulating case, a first case coupled to the first insulating case to form a first insulated space, a second insulating case having at least a part thereof disposed inside the first insulated space, a second case coupled to the second insulating case to form a second insulated space and a lamp disposed inside the second insulated space to be doubly insulated from external heat.

The second insulating case may include a screw and the second case may include a location determination protrusion configured to protrude outward in a radial direction from a side surface of the second case.

The first case may include a through hole through which the screw passes, and a location determination groove formed outwardly in a radial direction of the through hole from one side of the through hole to correspond to the location determination protrusion.

The lamp assembly may further include a ring member into which the screw is inserted to minimize a gap between the through hole and the second insulating case.

In accordance with still another aspect of the present disclosure, an oven includes a body having a cooking chamber, a lamp disposed inside the body, a first insulating case having at least a part thereof disposed inside the cooking chamber and configured to primarily shield the lamp from heat of the cooking chamber and a second insulating case having at least a part thereof disposed inside the first insulating case and configured to accommodate the lamp to secondarily shield the lamp from the heat of the cooking chamber.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the accompanying drawings.

Figure 1:
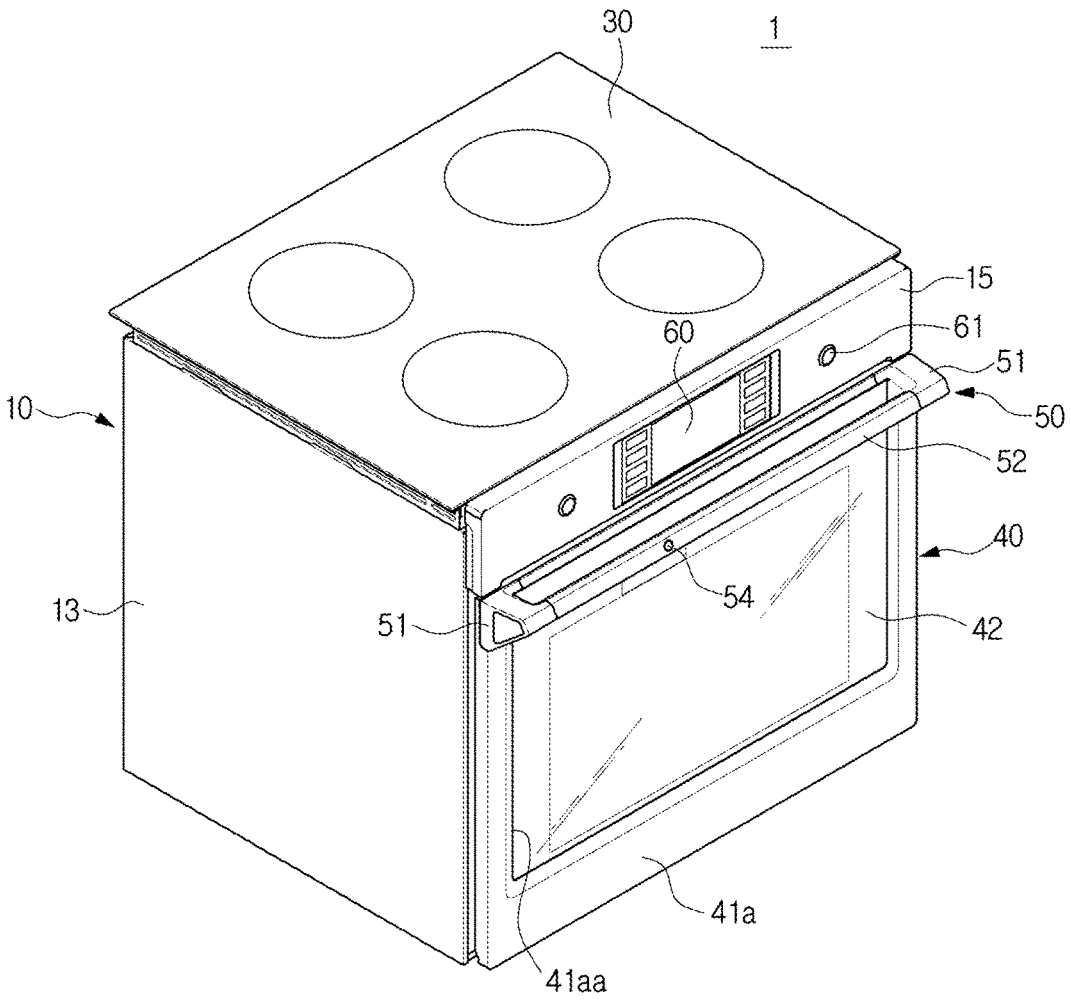
FIG. 1 is a perspective view of an oven in accordance with one embodiment of the present disclosure.
Figure 2:
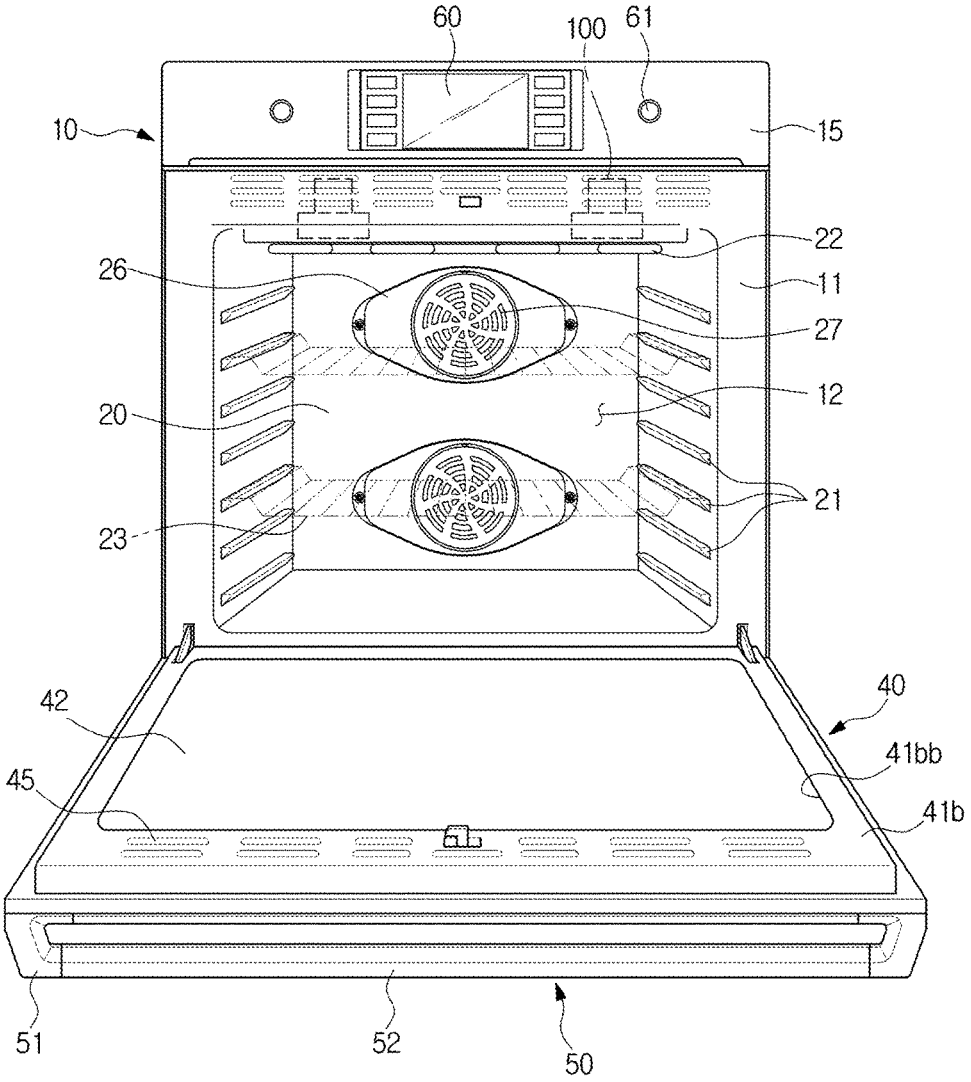
FIG. 2 is a view illustrating a state in which a door is opened in the oven in accordance with one embodiment of the present disclosure.
Figure 3:
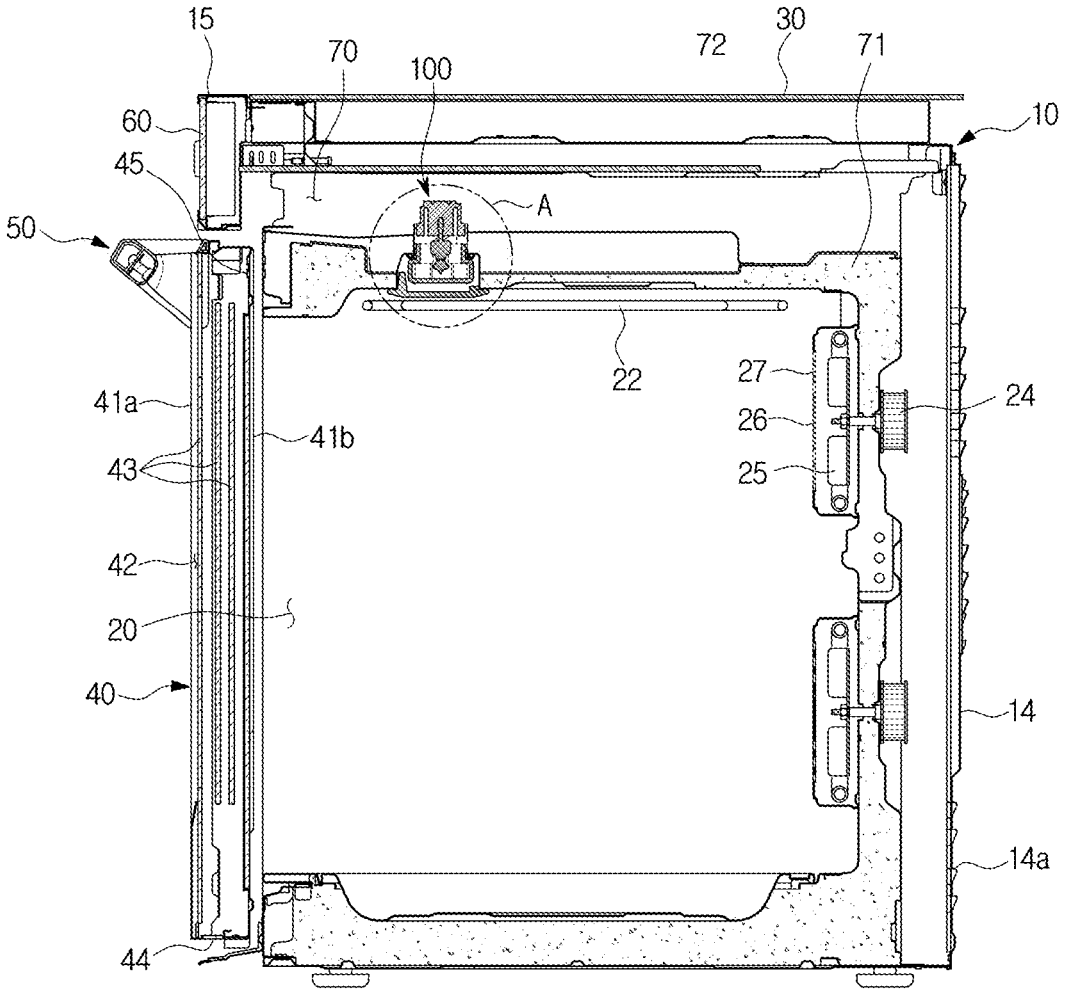
FIG. 3 is a side cross-sectional view of the oven in accordance with one embodiment of the present disclosure.
Figure 4:
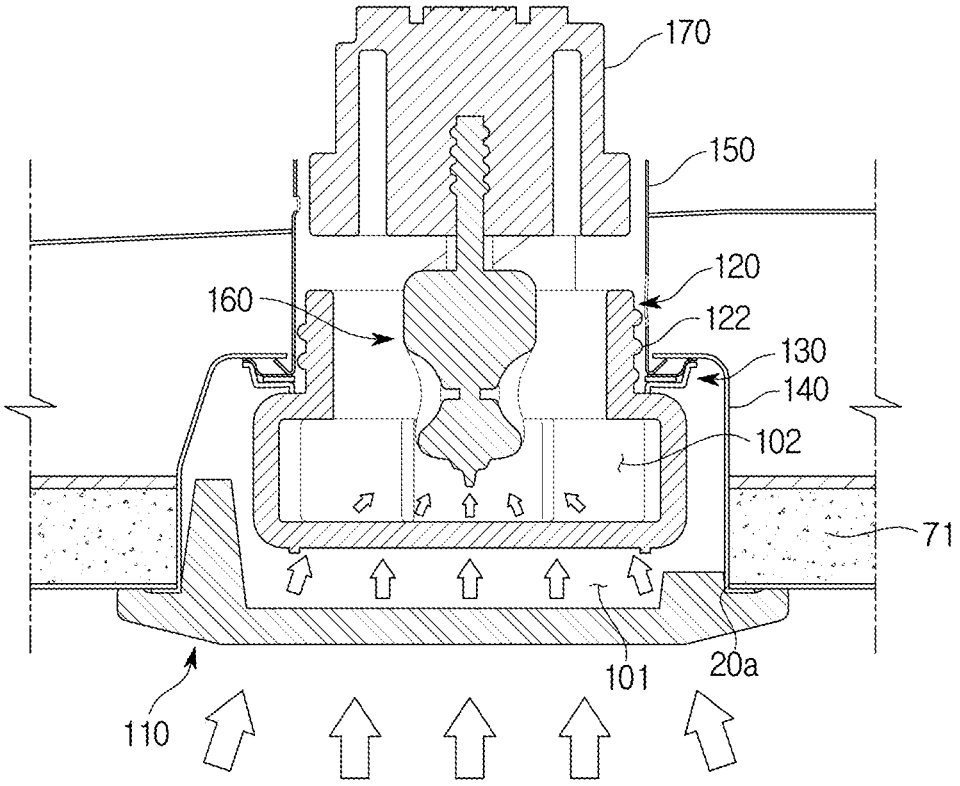
FIG. 4 is an enlarged view of part A in FIG. 3.

FIG. 1 is a perspective view of an oven in accordance with one embodiment of the present disclosure. FIG. 2 is a view illustrating a state in which a door is opened in the oven in accordance with one embodiment of the present disclosure, and FIG. 3 is a side cross-sectional view of the oven in accordance with one embodiment of the present disclosure. Further, FIG. 4 is an enlarged view of part A in FIG. 3.

An oven 1 may include a housing 10 forming an appearance thereof, a cooking chamber 20 located inside the housing 10, and a cooktop 30, which is provided on an upper end of oven 1 to have a container including a food placed thereon and is capable of heating the container. Alternatively, the oven 1 may not include a cooktop on an upper surface thereof.

The housing 10 may include a front panel 11 forming a front surface of the housing 10, a side panel 13 forming a side surface of the housing 10, and a rear panel 14 forming a rear surface of the housing 10.

The cooking chamber 20 is provided inside the housing 10 in a box type and a front surface thereof may be open so that a food may be placed therein and taken therefrom. An opening 12 provided to correspond to the cooking chamber 20 whose front surface is open may be provided in the front panel 11. The open front surface of the cooking chamber 20 may be opened and closed by a door unit 40.

A plurality of supports 21 may be provided inside the cooking chamber 20. Racks 23 on which the food may be placed may be mounted on the plurality of supports 21. The plurality of supports 21 may be provided to protrude from a left side wall and a right side wall of the cooking chamber 20.

Dividers (not shown) capable of dividing the cooking chamber 20 may be detachably mounted on the plurality of supports 21. Specifically, the dividers (not shown) are mounted laterally in the cooking chamber 20 and may divide the cooking chamber 20 into a plurality of cooking chambers.

The plurality of cooking chambers may have the same size or different sizes. The dividers (not shown) may include an insulating material to insulate each of the cooking chambers 20, thereby a space of the cooking chamber 20 can be utilized in various ways according to a purpose of a user.

A heater 22 configured to heat the food may be provided in the cooking chamber 20. In accordance with the embodiment, the heater 22 may be an electric heater including an electric resistor. Alternatively, unlike the embodiment, the heater 22 may be a gas heater configured to generate heat by combusting gas. That is, the oven 1 in accordance with the embodiment of the present disclosure may include an electric oven and a gas oven.

A circulating fan 25 configured to circulate air in the cooking chamber 20 so that the food is uniformly heated and a circulating motor 24 configured to drive the circulating fan 25 may be provided in the rear of the cooking chamber 20. A fan cover 26 configured to cover the circulating fan 25 may be provided in front of the circulating fan 25, and through holes 27 may be formed in the fan cover 26 so that air flows through the through holes 27.

The door unit 40 may be hinge-coupled to a lower side of the housing 10 to be rotatable with respect to the housing 10. Alternatively, although not shown, the door unit 40 may be hinge-coupled to a left side or a right side of the housing 10.

The door unit 40 may include a transparent portion 42 made of a transparent material such as a glass or the like so that a cooking process of the cooking food inside the cooking chamber 20 may be externally visible. The door unit 40 may include a front door frame 41*a* and a rear door frame 41*b* provided along edges of the transparent portion 42. The front door frame 41*a* may include a front frame opening 41*aa* at which the transparent portion 42 is formed, and the rear door frame 41*b* may include a rear frame opening 41*bb*.

A plurality of glass members 43 may be provided in the door unit 40 so that an inside of the cooking chamber 20 may be visible. The transparent portion 42 may be made of a transparent material other than the plurality of glass members 43. The plurality of glass members 43 may be disposed to be separated in frontward and rearward directions.

A door suction port 44 through which air may be introduced into the door unit 40 may be provided in a lower end of the door unit 40. External air introduced into the lower end of the door unit 40 may be heat-exchanged with heat transmitted from the cooking chamber 20 while moving toward an upper side of the door unit 40 and then be discharged through a door discharge port 45 provided in the rear door frame 41*b* located in the rear of the door unit 40. Through this configuration, the present disclosure may cool an internal heat of the door unit 40 due to the circulation of air.

A handle 50 graspable by a user so that the door may be easily opened and closed may be provided on an upper end of a front surface of the door unit 40. However, when the door unit 40 is hinge-coupled to the left side or the right side of the housing, the handle 50 may be provided on a right side or a left side of the front surface of the door unit 40, which corresponds to the side of the hinge-coupled door.

The handle 50 may protrude forward by a predetermined distance from the front surface of the door unit 40. That is, handle 50 may include a pair of handle supporters 51 extending forward from the front surface of the door unit 40, and a handle extender 52 connecting the pair of handle supporters 51.

A display module 60 configured to display various kinds of operational information of the oven 1 and allow the user to input operational commands may be provided at an upper portion of a front surface of the front panel 11. The display module 60 may be mounted on an electronic device chamber cover 15.

Also, a manipulator 61 provided to additionally operate the oven 1 may be provided on the electronic device chamber cover 15.

The oven 1 includes an electronic device chamber 70 configured to accommodate an electronic device configured to control operations of various components such as the display module 60 and the like. The electronic device chamber 70 is provided above the cooking chamber 20. An insulating member 71 configured to insulate the electronic device chamber 70 and the cooking chamber 20 may be provided between the electronic device chamber 70 and the cooking chamber 20 so that transmission of the heat of the cooking chamber 20 to the electronic device chamber 70 is prevented.

Also, the insulating member 71 may be provided to cover an entire outside of the cooking chamber 20 in addition to the electronic device chamber 70 and the cooking chamber 20 so that the heat of the cooking chamber 20 is not transmitted outside the oven 1.

A lamp assembly 100 may be provided above the cooking chamber 20. The lamp assembly 100 may illuminate an inside of the cooking chamber 20 so that the user may check a state of the food inside the cooking chamber 20. In accordance with one embodiment of the present disclosure, a pair of lamp assemblies 100 may be provided. However, since the number of the lamp assembly 100 is not limited, the number of the lamp assembly 100 may be more than or less than two.

As illustrated in FIGS. 3 and 4, the lamp assembly 100 may be disposed inside the housing 10. At least a part of the lamp assembly 100 may be exposed on an upper surface of the cooking chamber 20.

The lamp assembly 100 may be disposed adjacent to the heater 22. In one embodiment of the present disclosure, the heater 22 may be disposed under the lamp assembly 100. As the heater 22 releases high-temperature heat when the heater 22 is operated, a temperature of the lamp assembly 100 disposed adjacent to the heater 22 may be increased. Meanwhile, even when the lamp assembly 100 is not disposed adjacent to the heater 22 in another embodiment of the present disclosure, the inside of the cooking chamber 20 may maintain a high-temperature state to cook the food. At this time, the temperature of the lamp assembly 100 may also be gradually increased.

When the temperature of the lamp assembly 100 is increased to a predetermined temperature or higher, a lamp 160 may not be optimally operated.

That is, when the lamp 160 is overheated by heat of the cooking chamber 20, a lifetime thereof may be decreased. Accordingly, a temperature of the lamp 160 need be decreased.

In accordance with an aspect of the present disclosure, as illustrated in FIG. 4, the lamp 160 may be doubly insulated to decrease a temperature thereof exposed to a high-temperature state. Specifically, the heat of the cooking chamber 20 may be primarily blocked by a first insulating case 110. Heat of a first insulated space 101 discharged by the first insulating case 110 may be secondarily blocked by a second insulating case 120. Accordingly, the lamp 160 disposed inside a second insulated space 102 may be doubly insulated by the first insulating case 110 and the second insulating case 120. Due to the double insulation structure, overheating of the lamp 160 of the embodiment of the present disclosure may be prevented such that a lifetime of the lamp 160 may be increased.

Figure 5:
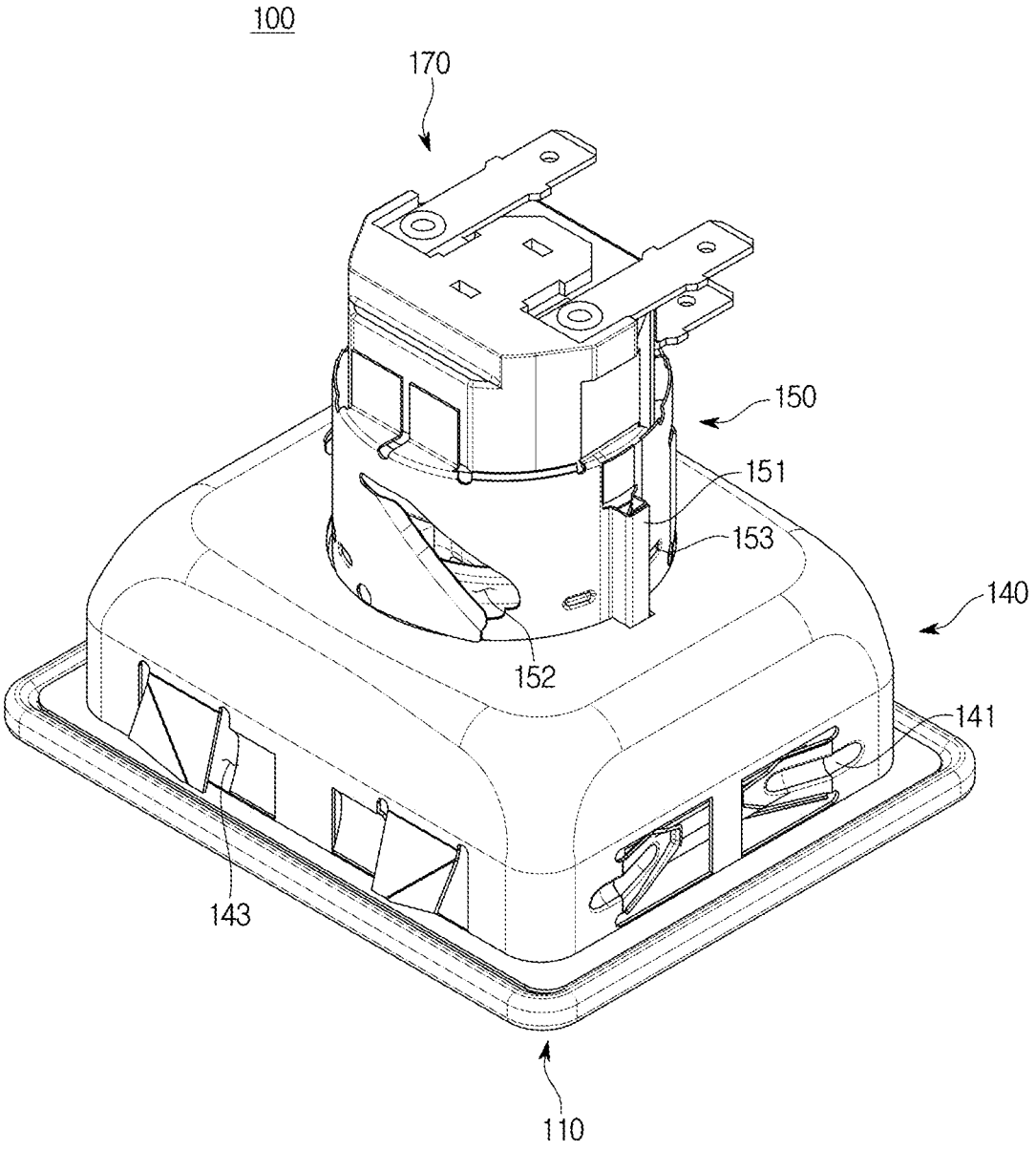
FIG. 5 is a perspective view of a lamp assembly in the oven in accordance with one embodiment of the present disclosure.
Figure 6:
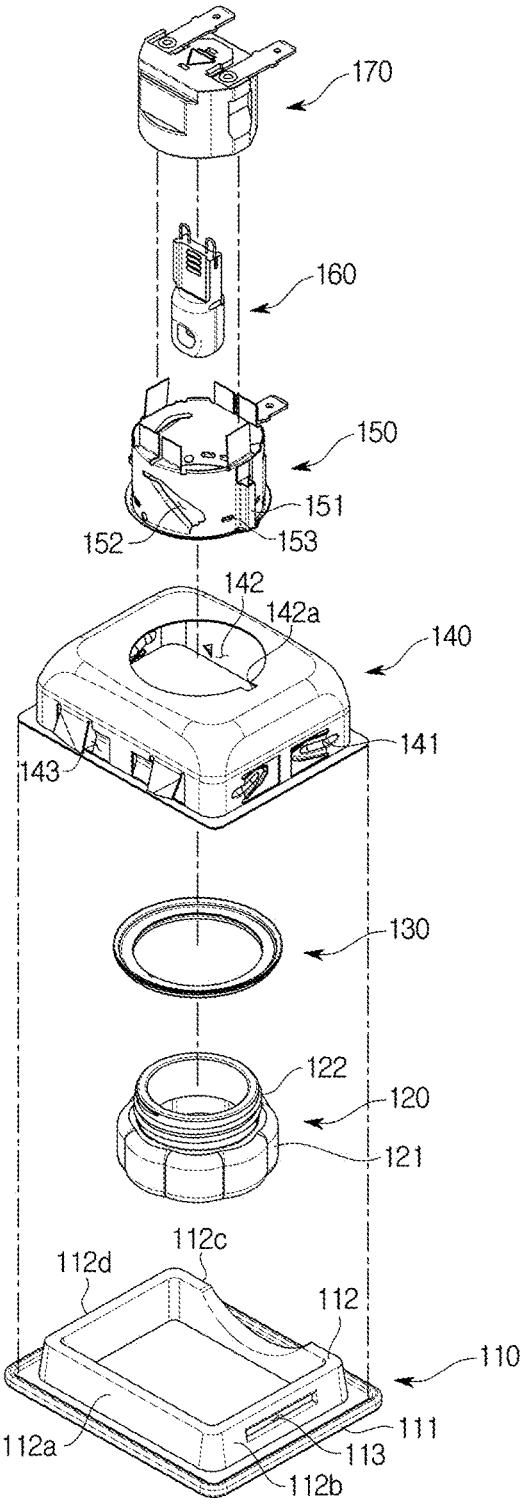
FIG. 6 is an exploded perspective view of the lamp assembly illustrated in FIG. 5.
Figure 7:
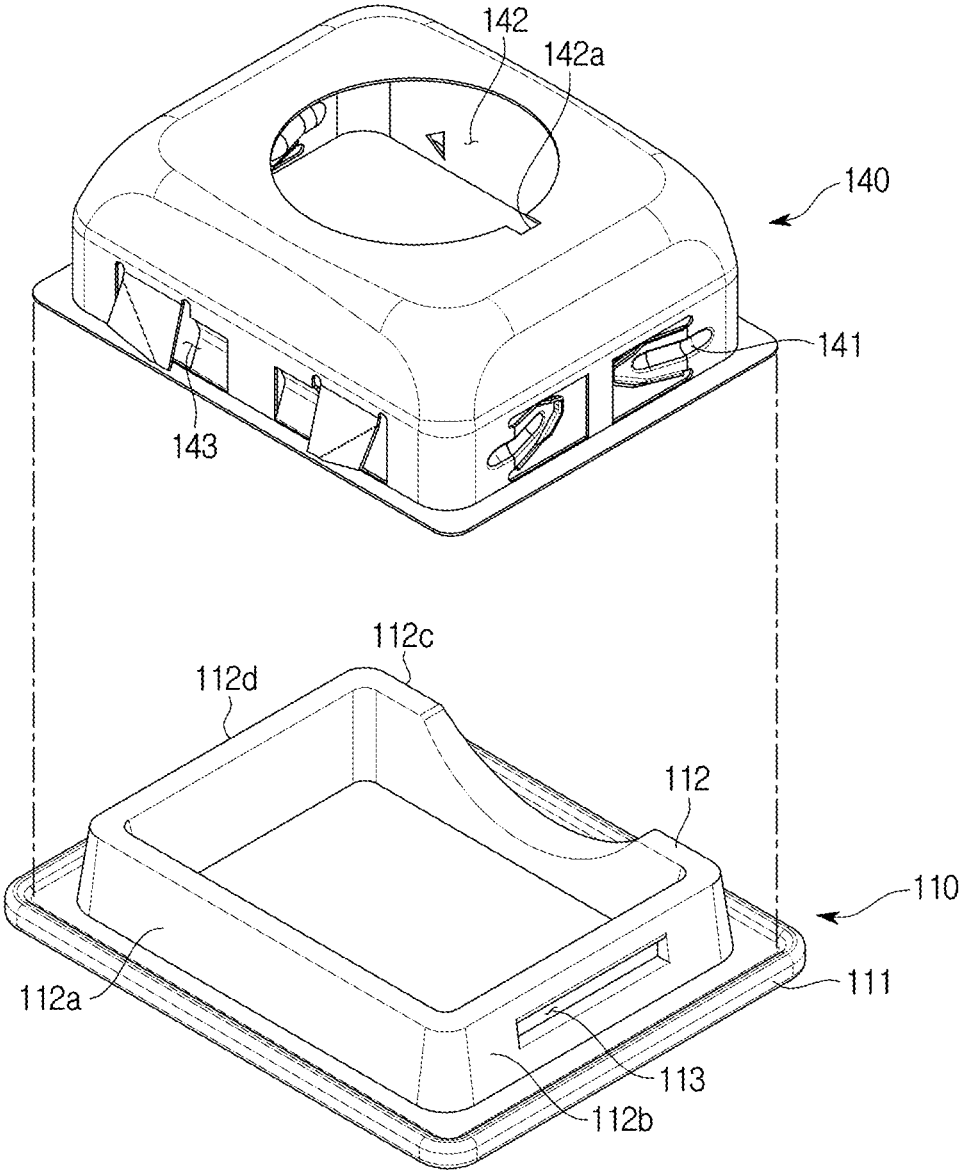
FIG. 7 is an enlarged view illustrating a first transparent case and a first case in the oven in accordance with one embodiment of the present disclosure.
Figure 8:
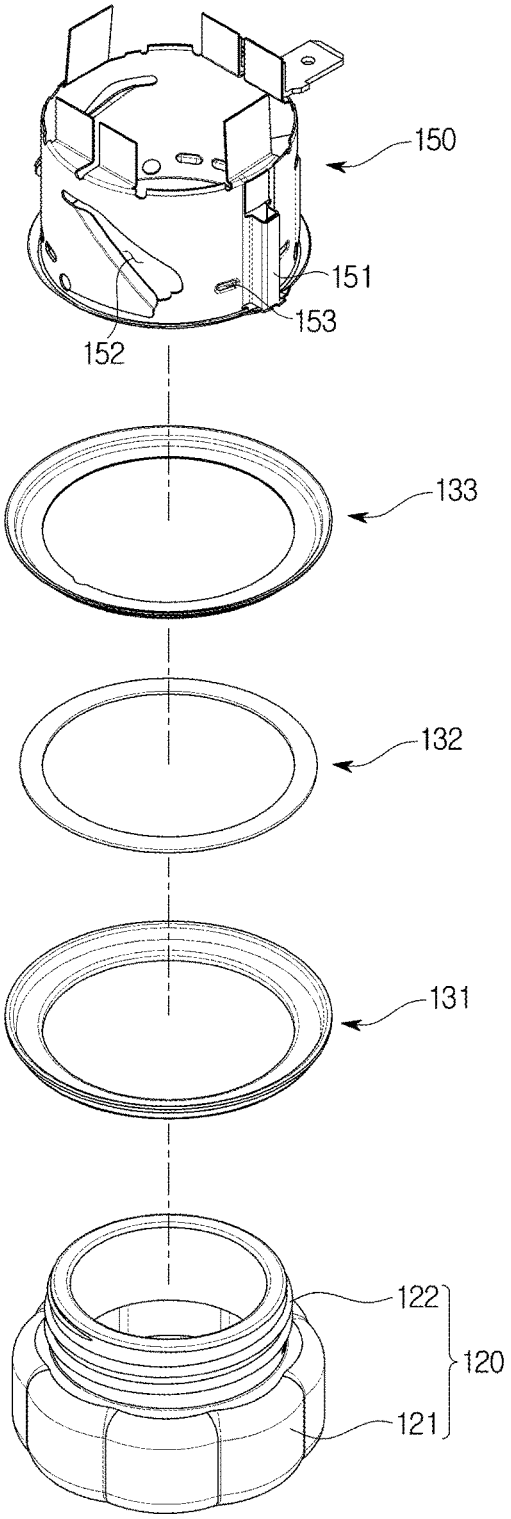
FIG. 8 is an enlarged view illustrating a second transparent case, a second case, and a ring member in the oven in accordance with one embodiment of the present disclosure.
Figure 9:
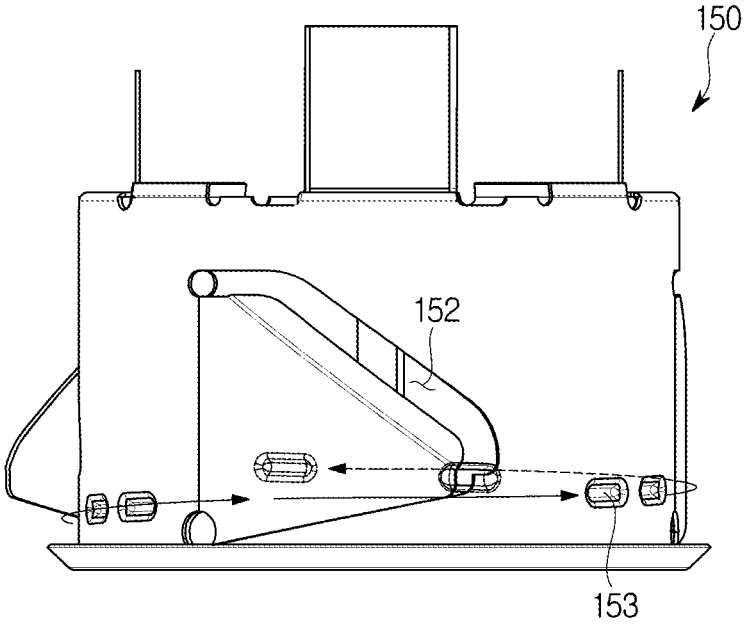
FIG. 9 is a side view of the second case in the oven in accordance with one embodiment of the present disclosure.

FIG. 5 is a view illustrating a lamp assembly in the oven in accordance with one embodiment of the present disclosure. FIG. 6 is an exploded perspective view of the lamp assembly illustrated in FIG. 5. FIG. 7 is an enlarged view illustrating a first insulating case and a first case in accordance with one embodiment of the present disclosure, and FIG. 8 is an enlarged view illustrating a second insulating case, a second case, and a ring member. FIG. 9 is a side view of the second case in the oven in accordance with one embodiment of the present disclosure.

As illustrated in FIGS. 5 to 9, the lamp assembly 100 may include the first insulating case 110, the second insulating case 120, a ring member 130, a first case 140, a second case 150, the lamp 160, and a socket 170.

The first insulating case 110 may include a bottom part 111 and a boss part 112. The bottom part 111 may be formed in an approximately rectangular shape. The boss part 112 may be formed to protrude upward from one surface of the bottom part 111. The boss part 112 may be formed along edges of the bottom part 111, and edges of the boss part 112 may be spaced a predetermined distance from the edges of the bottom part 111. That is, a circumference of the boss part 112 may be formed to be smaller than the border of the bottom part 111.

A perimeter of an opening 20*a* (see FIG. 4) formed in the cooking chamber 20 may be formed to be larger than a perimeter of the boss part 112 and may be formed to be smaller than a perimeter of the bottom part 111. The boss part 112 may be inserted into the opening 20*a*. Since the bottom part 111 blocks a gap between the opening 20*a* and the boss part 112, a discharge of the heat of the cooking chamber 20 through the opening 20*a* may be prevented.

The boss part 112 may include a front surface 112*a*, side surfaces 112*b* and 112*d*, and a rear surface 112*c*. A hooking groove 113 may be provided in each of the side surfaces 112*b* and 112*d* of the boss part 112. The hooking groove 113 may be formed by being recessed in inward directions of the side surfaces 112*b* and 112*d*. An elastic piece 141 of the first case 140 may be caught on the hooking groove 113.

The first case 140 may include the elastic piece 141 so that the first insulating case 110 is easily coupled to and separated from the first case 140. The elastic piece 141 may be formed by bending parts of both side surfaces of the first case 140 inward. The elastic piece 141 may have elasticity. Since the elastic piece 141 may be integrally formed with the first case 140, the first case 140 may be made of a material having elasticity. For example, the first case 140 may include a metal material.

As the elastic piece 141 is caught on the hooking groove 113 of the first insulating case 110, the first case 140 may be coupled to the first insulating case 110 without a separate coupling member. Also, the first insulating case 110 may be easily separated from the first case 140 using the elasticity of the elastic piece 141.

The elastic piece 141 may be provided on both of the side surfaces of the first case 140 to correspond to the hooking groove 113. Accordingly, locations and the number of elastic pieces 141 may be changed according to locations and the number of hooking grooves 113.

The first case 140 may include a first outlet 143 so that heat of the first case 140 is discharged outwardly. The first outlet 143 may be provided in one surface of the first case 140. The first outlet 143 may be provided by cutting a part of the first case 140 and bending the part outward. In accordance with one embodiment of the present disclosure, the first outlet 143 may be formed in a front surface of first case 140.

The first case 140 may include a through hole 142. The through hole 142 may be formed by cutting a part of an upper surface of the first case 140. The through hole 142 may be provided in a circle shape.

The first case 140 may further include a location determination groove 142*a* formed to extend outward in a radial direction of the through hole 142. The second insulating case 120 and the second case 150 may be inserted into the through hole 142. Also, a location determination protrusion 151 of the second case 150 may be inserted into the location determination groove 142*a* of the first case 140. The above will be described in detail below.

The second insulating case 120 may be provided in an approximately cylindrical shape. The second insulating case 120 may include a body 121 and a screw 122. The screw 122 may be provided at an upper end of the body 121.

A diameter of the body 121 may be provided to be larger than a diameter of the screw 122. Also, the diameter of the body 121 may be provided to be larger than a diameter of the through hole 142, and the diameter of the screw 122 may be provided to be smaller than the diameter of the through hole 142, thereby the screw 122 may pass through the through hole 142 while the body 121 may not pass therethrough and is caught on the through hole 142.

The second case 150 may be provided in a cylindrical shape with open upper and lower surfaces. The second case 150 may include the location determination protrusion 151, a second outlet 152, and a coupling protrusion 153.

The location determination protrusion 151 may be formed to protrude outward in a radial direction of the second case 150. The location determination protrusion 151 may be provided to correspond to the location determination groove 142*a* to be inserted thereinto. As the location determination protrusion 151 is inserted into the location determination groove 142*a*, the second case 150 may not rotate against the first case 140. Also, the second case 150 may be coupled to the first case 140 in a predetermined direction. That is, the second case 150 may be mounted at a specific location when the second case 150 is mounted on the first case 140.

The second outlet 152 may be provided in a side surface of the second case 150. The second outlet 152 may be provided by cutting a part of the side surface of the second case 150 and bending the part outward. Since the second outlet 152 is provided, heat of the second case 150 may be discharged through the second outlet 152. In accordance with one embodiment of the present disclosure, a plurality of second outlets 152 may be provided and the second outlets 152 may be disposed to be separated along a circumferential direction of the second case 150.

The second case 150 may include the coupling protrusion 153. The coupling protrusion 153 may protrude inside the second case 150 from an inner circumferential surface of the second case 150. A plurality of coupling protrusions 153 may be provided and the protrusions 153 may be disposed to be separated along the inner circumferential surface of the second case 150.

FIG. 9 is a view illustrating a disposition structure of the coupling protrusion 153 in a side view of the second case.

As illustrated in FIG. 9, the coupling protrusion 153 may be disposed in a spiral form along the inner circumferential surface of the second case 150. The second case 150 may be screw-coupled to the second insulating case 120 through a disposition of the coupling protrusion 153. That is, since the coupling protrusion 153 is screw-coupled to the screw 122, the second case 150 may be coupled to the second insulating case 120. Meanwhile, a user may couple the second insulating case 120 to the second case 150 or may separate the second insulating case 120 from the second case 150 by easily rotating the second insulating case 120 without a separate coupling member.

The lamp assembly 100 may include the ring member 130.

At least a part of the second insulating case 120 may be disposed inside the through hole 142 of the first case 140, and the remaining parts thereof may be disposed outside the through hole 142. That is, the body 121 may be disposed inside the first case 140, and the screw 122 may pass through the through hole 142 and be disposed outside the first case 140. At this time, a gap may be formed between the through hole 142 and the screw 122. The ring member 130 may be provided between the first case 140 and the second insulating case 120 so that the gap is minimized and the first case 140 is stably coupled to the second insulating case 120.

In accordance with one embodiment of the present disclosure, the ring member 130 may include a first ring member 131, a second ring member 132, and a third ring member 133. The first ring member 131, the second ring member 132, and the third ring member 133 may be sequentially stacked. Since a plurality of ring members 130 are provided, a relatively large gap may be reduced. However, the embodiment is not limited thereto and one ring member may also be provided.

The lamp assembly 100 may include the socket 170 and the lamp 160 mounted in the socket 170. Power may be supplied to the lamp 160 via the socket 170. The socket 170 may be inserted into and coupled to an upper portion of the second case 150. Accordingly, the socket 170 may be coupled to the second case 150 without a coupling member or may be separated from the second case 150. Likewise, the lamp 160 may be coupled to the socket 170 without a coupling member or may be separated from the socket 170. That is, in accordance with one aspect of the present disclosure, a user does not require a separate coupling member when assembling or disassembling a lamp assembly. That is, the user may easily replace the lamp.

In accordance with one embodiment of the present disclosure, the lamp 160 may include a halogen lamp. As a temperature inside the cooking chamber 20 is very high, a halogen lamp having high temperature resistance may be used in order to be operated at a high temperature.

The first insulating case 110 and the second insulating case 120 may be made to be transparent so that light emitted from the lamp 160 may be transmitted to the cooking chamber 20. For example, the first insulating case 110 and the second insulating case 120 may be provided with a glass material. However, the material of the cases is not limited to the glass material, and the first insulating case 110 and the second insulating case 120 may be made not to be transparent as long as the first insulating case 110 and the second insulating case 120 are able to transmit light emitted from the lamp.

Hereinafter, a process of changing the lamp in the oven in accordance with one embodiment of the present disclosure will be described.

Figure 10:
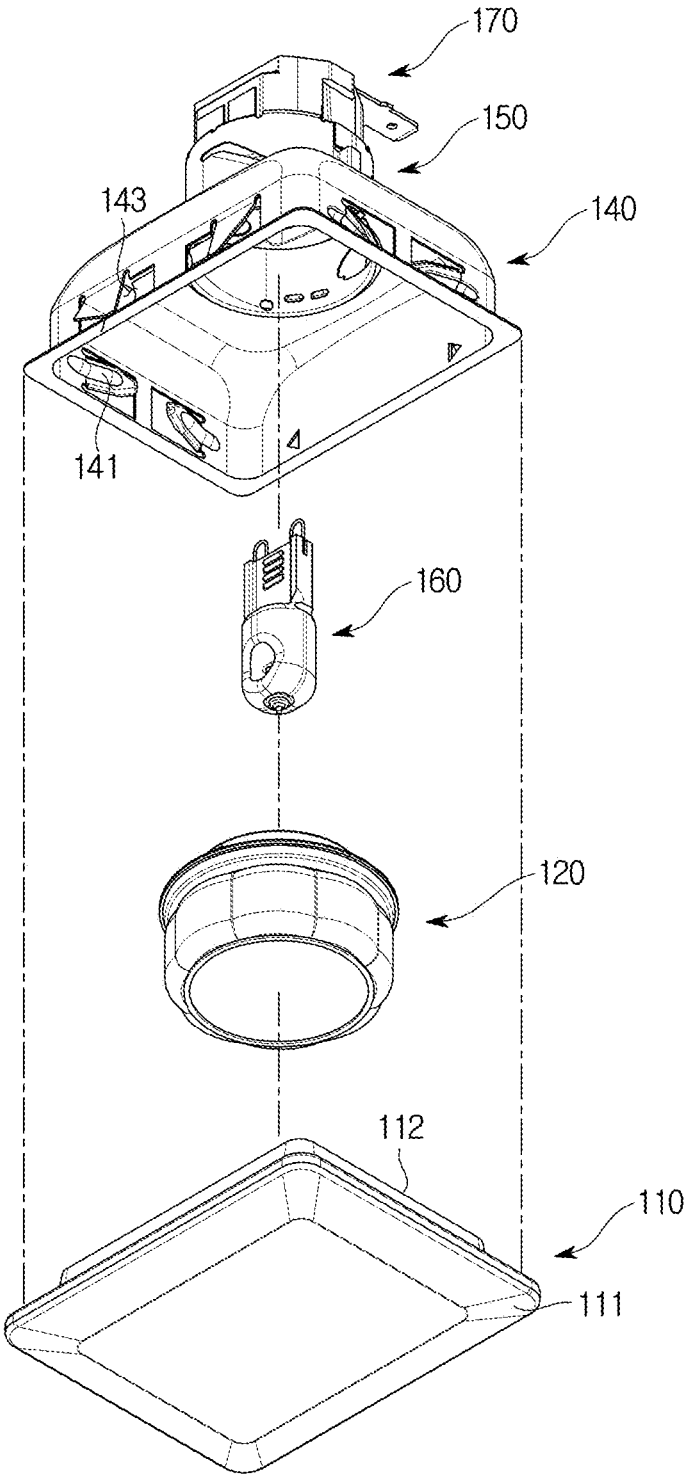
FIG. 10 is an exploded view illustrating main components of the lamp assembly in the oven in accordance with one embodiment of the present disclosure.

As illustrated in FIG. 10, the socket 170 may be mounted inside the housing 10. The second case 150 may be insertion-coupled to a lower portion of the socket 170. A lower end of the second case 150 may pass through the through hole 142 of the first case 140 and be disposed inside the first case 140. The socket 170, the second case 150 and the first case 140 may be fixed inside a housing.

When a user want to change the lamp 160, the user may separate the first insulating case 110 from the first case 140 without a separate coupling member. Also, the second insulating case 120 disposed inside the first insulating case 110 may be separated from the second case 150 by being rotated. Since the lamp 160 is disposed inside the second insulating case 120, the lamp 160 may be easily replaced by performing the above process in reverse after the lamp 160 is replaced.

Figure 11:
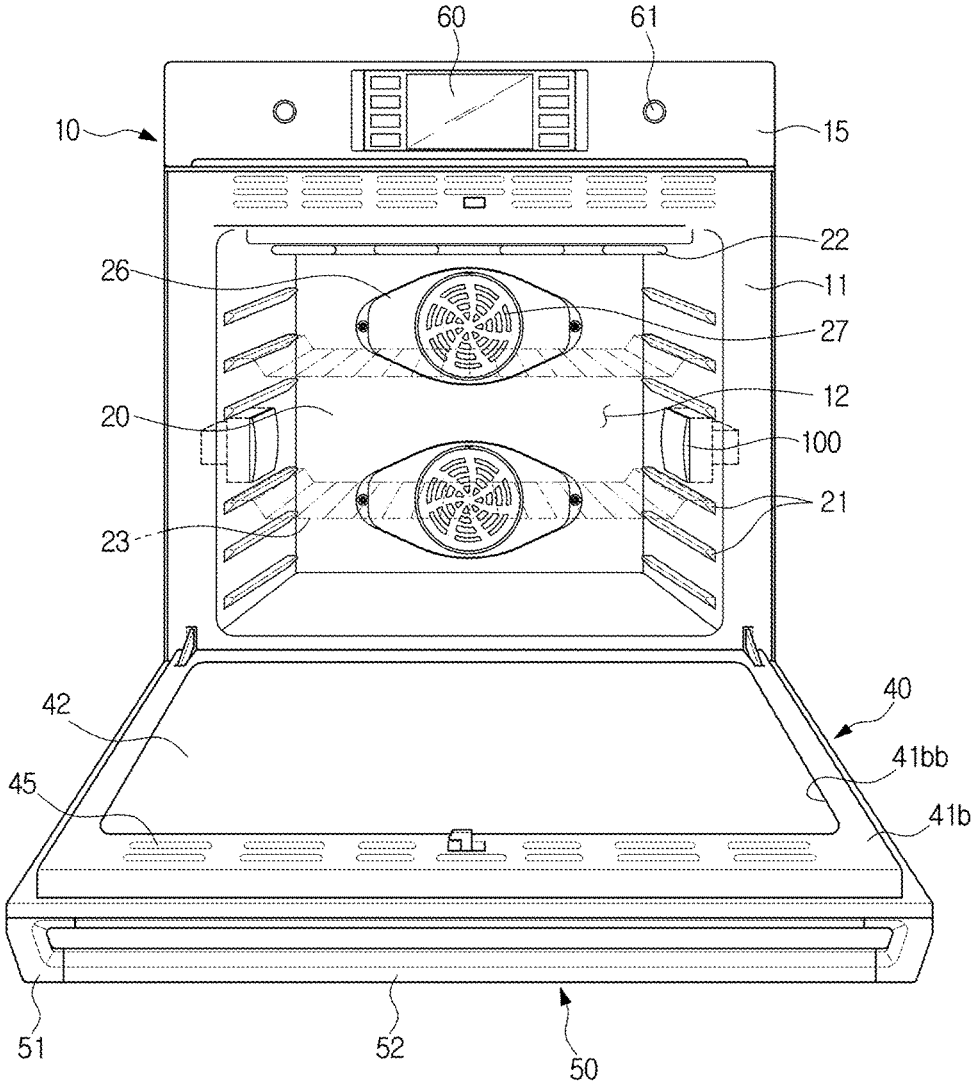
FIG. 11 is a view illustrating a state in which a door is opened in an oven in accordance with another embodiment of the present disclosure.

FIG. 11 is a view illustrating a state in which a door is opened in an oven in accordance with another embodiment of the present disclosure.

As illustrated in FIG. 11, lamp assemblies 100 may be disposed on both side surfaces of a cooking chamber 20. That is, according to various embodiments of the present disclosure, the lamp assembly 100 may be disposed on an upper surface or the both of the side surfaces of the cooking chamber 20, and although not shown in the drawings, the lamp assembly 100 may also be disposed on a lower surface of the cooking chamber 20.

As is apparent from the above description, a lamp whose lifetime is increased and an oven including the lamp can be provided.

In accordance with an aspect of the present disclosure, a lamp having a double insulation structure and an oven including the lamp can be provided.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An oven comprising:

a cooking chamber;

an insulating member provided to cover an outside of the cooking chamber and configured to insulate the cooking chamber;

a first insulating case mounted on one surface of the cooking chamber;

a first case penetrating the insulating member and coupled to the first insulating case to form a first insulated space;

a second insulating case penetrating a surface of the first case and having at least a part thereof disposed inside the first insulated space;

a second case of which one end is coupled to the second insulating case to form a second insulated space;

a lamp disposed inside the second insulated space to be doubly insulated from heat of the cooking chamber; and a socket coupled to another end of the second case and in which the lamp is mounted, wherein the first insulated space and the second insulated space are partitioned from each other by the second insulating case.

2. The oven according to claim 1, wherein the first case includes a through hole through which a part of the second case and a part of the second insulating case pass.

3. The oven according to claim 2, wherein the first case further includes a location determination groove formed outwardly in a radial direction of the through hole from one side of the through hole.

4. The oven according to claim 3, wherein the second case includes a location determination protrusion formed to protrude outward in the radial direction from a side surface of the second case to correspond to the location determination groove.

5. The oven according to claim 1, wherein:

the first case includes an elastic piece provided on a side surface thereof; and the first insulating case includes a hook groove provided to catch the elastic piece.

6. The oven according to claim 1, wherein the first insulating case includes a boss part inserted into the first case.

7. The oven according to claim 1, further comprising a ring member provided between the first case and the second insulating case to minimize a gap between the first case and the second insulating case.

8. The oven according to claim 1, wherein each of the first case and the second case includes an outlet to discharge heat.

9. The oven according to claim 8, wherein the outlet is formed by at least a part of each of the first case and the second case being bent.

10. The oven according to claim 1, wherein:

the second insulating case includes a screw; and the second case includes a coupling protrusion provided to be screw-coupled to the screw.

11. The oven according to claim 10, wherein the coupling protrusion is disposed in a spiral form along an inner circumference surface of the second case.

12. The oven according to claim 1, wherein each of the first insulating case and the second insulating case includes a glass material.

13. The oven according to claim 1, wherein the lamp includes a halogen lamp.

14. The oven according to claim 1, wherein the first insulating case is mounted on an upper surface of the cooking chamber.

15. The oven according to claim 1, wherein the first insulating case is mounted on a side surface of the cooking chamber.

16. A lamp assembly comprising:

a first insulating case;

a first case coupled to the first insulating case to form a first insulated space;

a second insulating case penetrating a surface of the first case and having at least a part thereof disposed inside the first insulated space;

a second case of which one end is coupled to the second insulating case to form a second insulated space;

a lamp disposed inside the second insulated space to be doubly insulated from external heat; and a socket coupled to another end of the second case and in which the lamp is mounted, wherein the first insulated space and the second insulated space are partitioned from each other by the second insulating case.

17. The lamp assembly according to claim 16, wherein:

the second insulating case includes a screw; and the second case includes a location determination protrusion configured to protrude outward in a radial direction from a side surface of the second case.

18. The lamp assembly according to claim 17, wherein the first case includes a through hole through which the screw passes and a location determination groove formed outwardly in a radial direction of the through hole from one side of the through hole to correspond to the location determination protrusion.

19. The lamp assembly according to claim 18, further comprising a ring member into which the screw is inserted to minimize a gap between the through hole and the second insulating case.

20. An oven comprising:

a body having a cooking chamber;

an insulating member provided to cover an outside of the cooking chamber and configured to insulate the cooking chamber;

a lamp disposed inside the body;

a first insulating case having at least a part thereof disposed inside the cooking chamber and configured to primarily shield the lamp from heat of the cooking chamber;

a case penetrating the insulating member and coupled to the first insulating case to cover the lamp; and a second insulating case penetrating a surface of the case, having at least a part thereof disposed inside the case and configured to accommodate the lamp to secondarily shield the lamp from the heat of the cooking chamber, wherein the first insulating case and the second insulating case are spaced apart from each other so that an insulated space is formed therebetween.

* * * * *